US008786515B2

(12) United States Patent
Paradiso et al.

(10) Patent No.: US 8,786,515 B2
(45) Date of Patent: Jul. 22, 2014

(54) PHASED ARRAY ANTENNA MODULE AND METHOD OF MAKING SAME

(75) Inventors: Louis R. Paradiso, Satellite Beach, FL (US); Sean Ortiz, West Melbourne, FL (US); Donald Franklin Hege, Palm Bay, FL (US); James J. Rawnick, Palm Bay, FL (US); Lora A. Theiss, Indialantic, FL (US); Jerry B. Schappacher, Melbourne Beach, FL (US)

(73) Assignee: Harris Corporation, Melbourne, FL (US)

( * ) Notice: Subject to any disclaimer, the term of this patent is extended or adjusted under 35 U.S.C. 154(b) by 386 days.

(21) Appl. No.: 13/221,382

(22) Filed: Aug. 30, 2011

(65) Prior Publication Data

US 2013/0050055 A1 Feb. 28, 2013

(51) Int. Cl.
*H01Q 21/00* (2006.01)
*H01P 3/06* (2006.01)

(52) U.S. Cl.
CPC ..... *H01Q 21/0093* (2013.01); *H01Q 21/0025* (2013.01); *H01Q 21/0006* (2013.01); *H01P 3/06* (2013.01)
USPC ..... 343/893; 343/700 MS; 343/853

(58) Field of Classification Search
None
See application file for complete search history.

(56) References Cited

U.S. PATENT DOCUMENTS

| | | | | |
|---|---|---|---|---|
| 4,823,136 | A | 4/1989 | Nathanson et al. | |
| 5,132,648 | A | 7/1992 | Trinh et al. | |
| 5,327,152 | A | 7/1994 | Kruger et al. | 343/853 |
| 6,060,388 | A | 5/2000 | Jones et al. | |
| 6,307,510 | B1 | 10/2001 | Taylor et al. | 343/700 |
| 6,483,464 | B2 | 11/2002 | Rawnick et al. | 343/700 |
| 6,828,556 | B2 * | 12/2004 | Pobanz et al. | 250/336.1 |
| 7,038,625 | B1 | 5/2006 | Taylor et al. | 343/700 |
| 7,126,542 | B2 | 10/2006 | Mohamadi | 343/700 |
| 7,548,205 | B2 | 6/2009 | Mohamadi | 343/700 |
| 7,598,918 | B2 | 10/2009 | Durham et al. | 343/770 |
| 7,646,344 | B2 | 1/2010 | Liu | 343/700 |
| 7,948,335 | B2 | 5/2011 | Sherrer et al. | 333/244 |
| 2003/0122079 | A1 | 7/2003 | Pobanz et al. | |
| 2004/0008142 | A1 * | 1/2004 | Guo et al. | 343/701 |
| 2005/0227660 | A1 | 10/2005 | Hashemi et al. | 455/276.1 |
| 2006/0044430 | A1 * | 3/2006 | Mouli | 348/294 |
| 2007/0152882 | A1 | 7/2007 | Hash et al. | 343/700 |

(Continued)

FOREIGN PATENT DOCUMENTS

WO 2004004061 1/2004

OTHER PUBLICATIONS

Sherrer et al., "PolyStrata™ Technology: A disruptive approach for 3D Microwave Components and Modules," Nuvotronics, Radford, Virginia, Slides 1-39.

(Continued)

*Primary Examiner* — Trinh Dinh
(74) *Attorney, Agent, or Firm* — Allen, Dyer, Doppelt, Milbrath & Gilchrist, P.A.

(57) ABSTRACT

A phased array antenna includes a semiconductor wafer, with radio frequency (RF) circuitry fabricated on top side of the semiconductor wafer. There is an array of antenna elements above the top side of the semiconductor wafer, and a coaxial coupling arrangement coupling the RF circuitry and the array of antenna elements. The coaxial coupling arrangement may include a plurality of coaxial connections, each having an outer conductor, an inner conductor, and a dielectric material therebetween. The dielectric material may be air.

21 Claims, 6 Drawing Sheets

(56) References Cited

U.S. PATENT DOCUMENTS

| | | | | |
|---|---|---|---|---|
| 2008/0047732 | A1* | 2/2008 | Park et al. | 174/107 |
| 2008/0079652 | A1 | 4/2008 | Mohamadi | |
| 2008/0252546 | A1* | 10/2008 | Mohamadi | 343/853 |
| 2009/0015483 | A1 | 1/2009 | Liu | 343/700 |
| 2010/0289717 | A1* | 11/2010 | Arslan et al. | 343/876 |
| 2011/0043301 | A1 | 2/2011 | Huettner | 333/136 |

OTHER PUBLICATIONS

Sherrer et al., "PolyStrata ™ Technology: A disruptive approach for 3D Microwave Components and Modules," Nuvotronics, Radford, Virginia, Jan. 20, 2010, Slides 1-39.

* cited by examiner

PHASED ARRAY ANTENNA MODULE AND METHOD OF MAKING SAME

FIELD OF THE INVENTION

The present invention relates to the field of antenna modules, and, more particularly, to phased array antenna modules and related methods.

BACKGROUND OF THE INVENTION

A phased array antenna comprises a group of antenna elements in which the relative phases of the respective signals feeding the antenna elements are varied thereby controlling the radiation pattern of the phased array antenna. The interface between the feed network and the antenna elements typically comprises connectors and cabling, and the connectors typically used may suffer from high signal loss. The connectors used for the interface may also be expensive and some antennas may require multiple connectors for each antenna element thereby adding complexity and/or cost to the antenna. In addition, space limitations on the antenna may result in size limitations on the connectors and/or make the removal of heat difficult.

U.S. Pat. No. 5,327,152 to Kruger et al. discloses an active aperture antenna including a plurality of antenna elements attached to one side of a support structure and a plurality of transmit/receive (T/R) modules attached to the other side of the support structure. The antenna elements are connected to the T/R modules by conductors passing through the support structure. In an alternative embodiment, the array elements may be mounted on a circuit board that is affixed to an upper surface of a support structure.

U.S. Pat. No. 6,483,464 to Rawnick et al. and assigned to the assignee of the present invention discloses a significant advance in phased array antennas. Each antenna unit of the phase array antenna comprises an antenna feed structure including a respective feed line for each antenna element and a feed line organizer body having passageways therein for receiving respective feed lines.

Further advances that reduce the loss in transmission lines, or that handle higher thermal loads may, however, be desirable. In addition, new methods of constructing these devices may be desirable, since current manufacturing methods for phased array antenna modules often involve an undesirable amount of costly and time consuming hand assembly.

SUMMARY OF THE INVENTION

In view of the foregoing background, it is therefore an object of the present invention to provide a phased array antenna module and a method of making that phased array antenna module.

This and other objects, features, and advantages in accordance with the present invention are provided by a phased array antenna. The phased array antenna includes a semiconductor wafer with circuitry (e.g. radio frequency (RF) and/or digital circuitry) fabricated on a top side and an array of antenna elements interconnected above the top side of the semiconductor wafer. There is a coaxial coupling arrangement between the RF circuitry and the array of antenna elements.

The coaxial coupling arrangement may comprise a plurality of coaxial connections, each comprising an outer conductor, an inner conductor, and a dielectric material therebetween. The dielectric material may include air.

In addition, the RF circuitry includes unconnected redundant arrays of RF circuit elements (low noise amplifiers, power amplifiers, phase shifters, vector modulators, time delays, and RF switches). The semiconductor wafer may have a plurality of conductive vias therein used in conjunction with micro coax to interconnect both RF and digital circuitry from the front to the backside of the wafer or wafer tile. On the backside of the wafer or wafer title power combiners or other circuitry is interconnected with micro coax and with at least some of the plurality of conductive vias. The power combiner may comprise a plurality of micro coaxial connections, each comprising an outer conductor, an inner conductor, and an air dielectric there between.

A method aspect is directed to a method of making a phased array antenna. The method includes fabricating radio frequency (RF) and/or digital circuitry on a top side of a semiconductor wafer. The method further includes forming a programmable coaxial coupling arrangement with the RF circuitry to interconnect the RF circuitry on the semiconductor wafer or wafer tile, and positioning an array of antenna elements above the top side of the semiconductor wafer and coupling the RF circuitry via the coaxial coupling arrangement.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
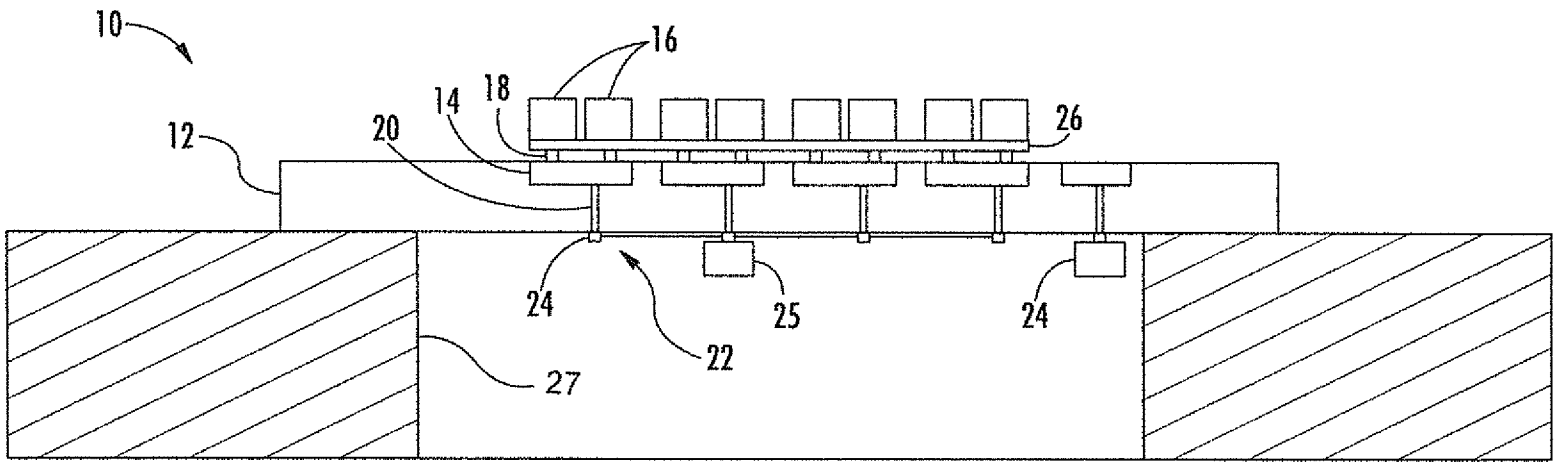
FIG. 1 is a cross sectional view of a phased array antenna module in accordance with the present invention.

Referring initially to FIG. 1, a phased array antenna module 10 and a method of making the phased array antenna module is now described. The phased array antenna module 10 includes a semiconductor wafer (or wafer tile) 12, such as may be fabricated from a silicon germanium (SiGe) in a bipolar complementary metal-oxide-semiconductor (BiCMOS) process, although it should be appreciated that wafers fabricated in other semiconductor processes may be used. In addition, it should be understood that the semiconductor wafer 12 may be an entire wafer or large sections of the wafer (wafer tile), and not merely an individual integrated circuit dies. Circuitry 14 (e.g. radiofrequency circuitry, digital circuitry, etc) is fabricated on a top side of the semiconductor wafer 12. The circuitry 14 may be RF circuitry as stated, may be suitable transmitter and/or receiver circuitry, and may include (but is not limited to) components such as low noise amplifiers, power amplifiers, phase shifters, filters, vector modulators, time delay blocks, and RF switches.

The phased array antenna module 10 includes an array of antenna elements 16 above the top side of the semiconductor wafer 12. By "above the top side," it should be understood that as shown in FIG. 1, the array of antenna elements 16 may be carried by, and integrated on, an antenna substrate 26. The array of antenna elements may 16 form a current sheet antenna (CSA), for example, and the antenna elements may be dipoles, but it should be appreciated that the antenna elements may be any suitable antenna radiator. Formation of the array of antenna elements 16 will be discussed below.

Figure 2:
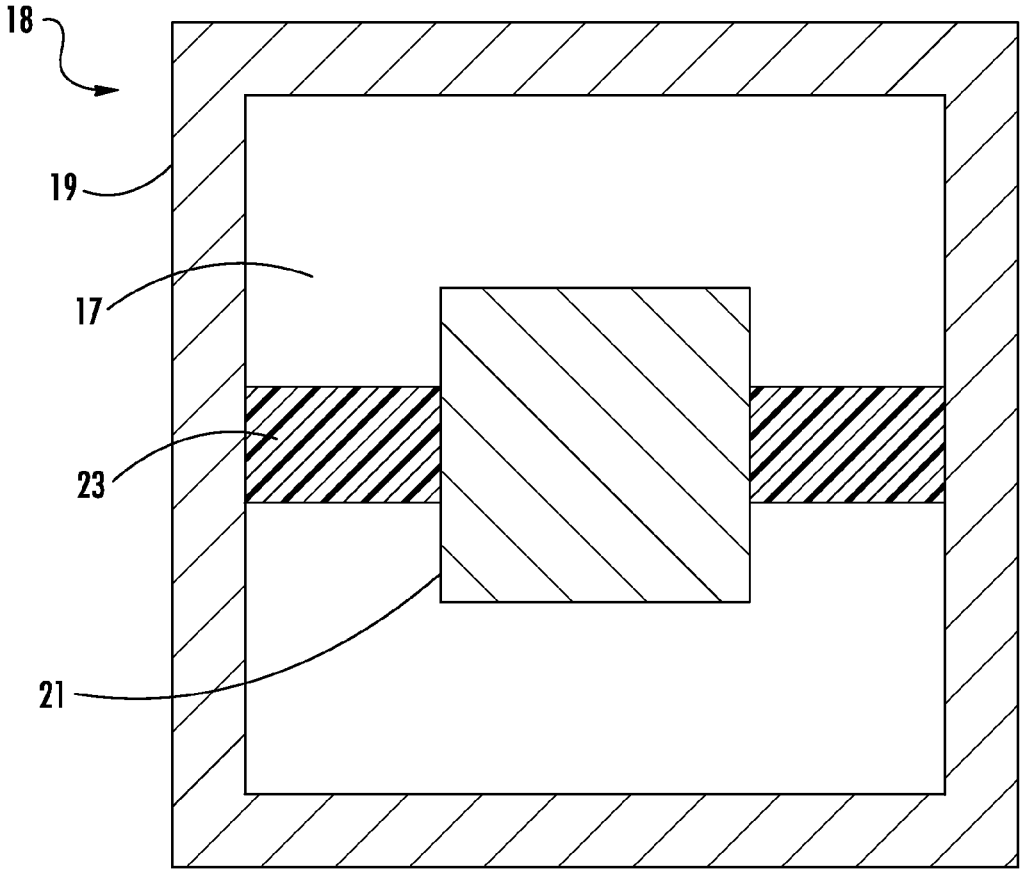
FIG. 2 is a cross sectional view of a coaxial connection of FIG. 1.

There is a coaxial coupling arrangement 18 between the RF circuitry 14 and the array of antenna elements 16. Referring additionally to FIG. 2, the coaxial coupling arrangement 18 includes a plurality of micro coaxial connections, and each of those coaxial coupling connections may include an outer conductor 19 and an inner conductor 21, with a dielectric material 17 therebetween. A dielectric support member 23 is coupled to the outer conductor 18 and inner conductor 21 to support the inner conductor. The dielectric material 17 may be air in some application. The coaxial connections are illustratively square shaped, but may be other shapes in other applications, and provide for better power handling characteristics and improved reliability.

The semiconductor wafer 12 has a plurality of conductive vias 20 formed therein. A power combiner 22 is on a back side of the semiconductor wafer 12 and is coupled to at least some of the vias 20. The vias 20 are used in conjunction with micro coaxial connections 18 to interconnect both circuitry 14 from the top to the backside of the wafer. The micro coaxial interconnects 14 and vias 20 are programmable, allowing coupling to only active, functioning RF circuitry 14. The power combiner 22 comprises a plurality of coaxial coupling arrangements 24 similar to those explained above, and coupled together. The power combiner 22 combines the power from the individual antenna elements of the array of antenna elements 16.

A connector 25 may be coupled to the output of the power combiner 22, so that other circuitry and devices may receive signals from, or send signals to, the phased array antenna module 10. In addition, another connector 24 or coaxial coupling arrangement may be used so that other devices for beam control may receive signals from, or send signals to, circuitry for digital control of the various components of the RF circuitry 14. A heat sink 27 is coupled to the back side of the semiconductor wafer 12.

The coaxial coupling arrangements 18, 24 enhance performance of the phased array antenna module 10 by reducing transmission losses, and by allowing higher thermal loads. In addition, as will be explained below, the method of making this phased array antenna module 10 allows for significant cost savings.

Figure 3:
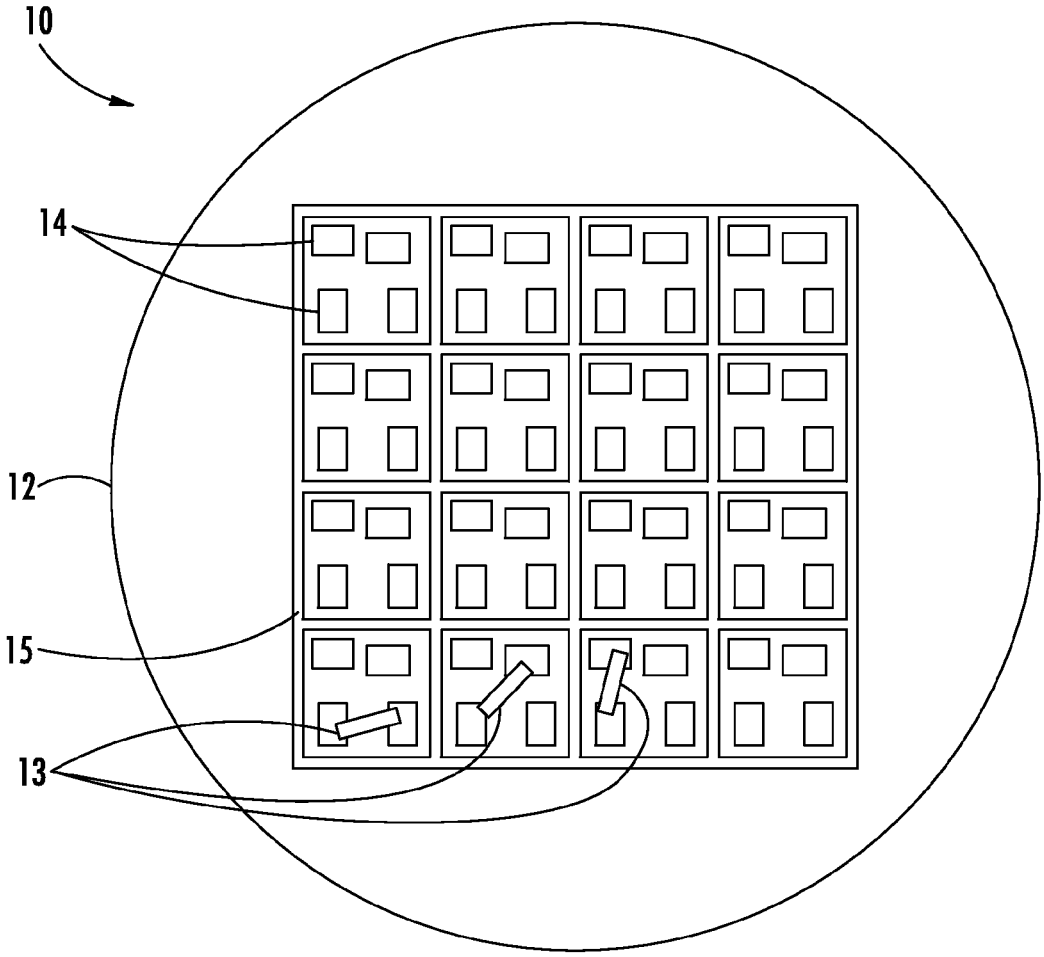
FIG. 3 is a top view of the phased array antenna module being constructed, showing RF circuitry, the control logic wafer bus, through silicon vias, and micro coaxial interconnections fabricated on a semiconductor wafer.
Figure 4:
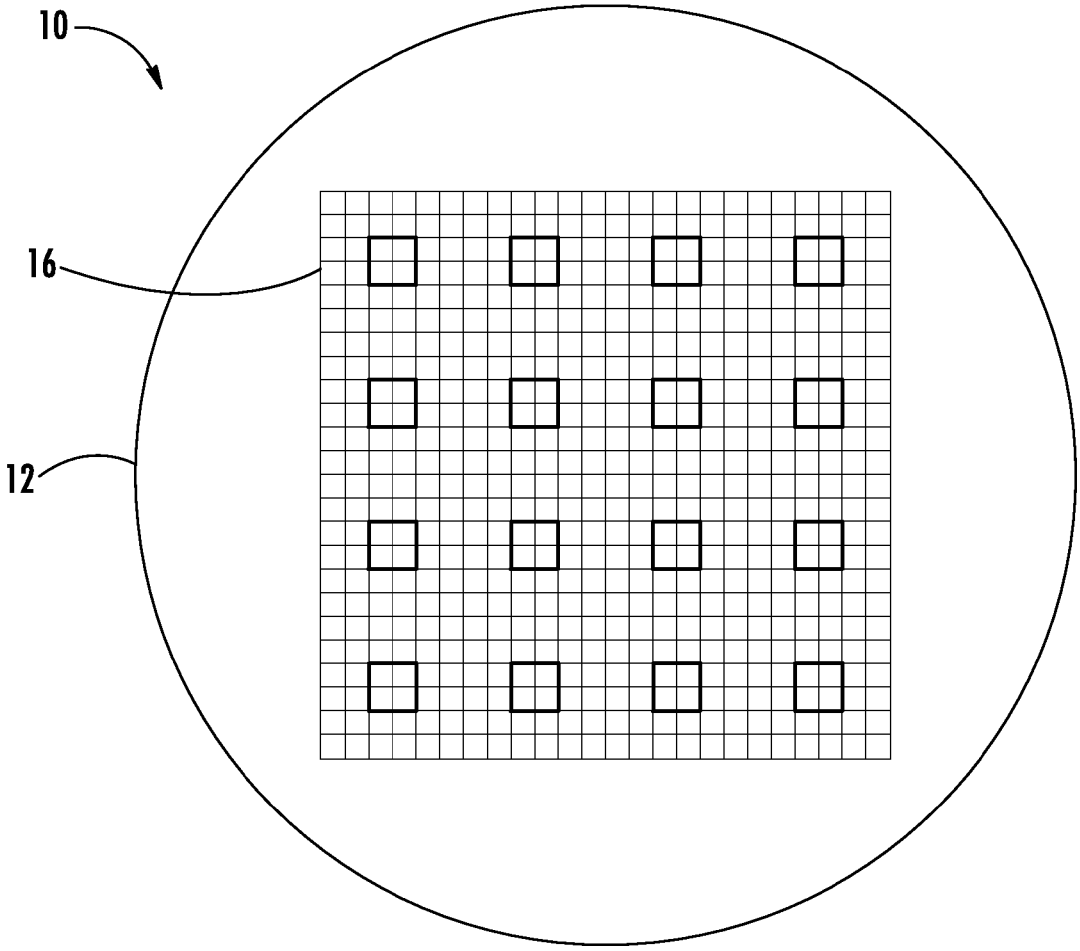
FIG. 4 is a top view of the phased array antenna being constructed, showing an array of antenna elements coupled to the RF circuitry.
Figure 6:
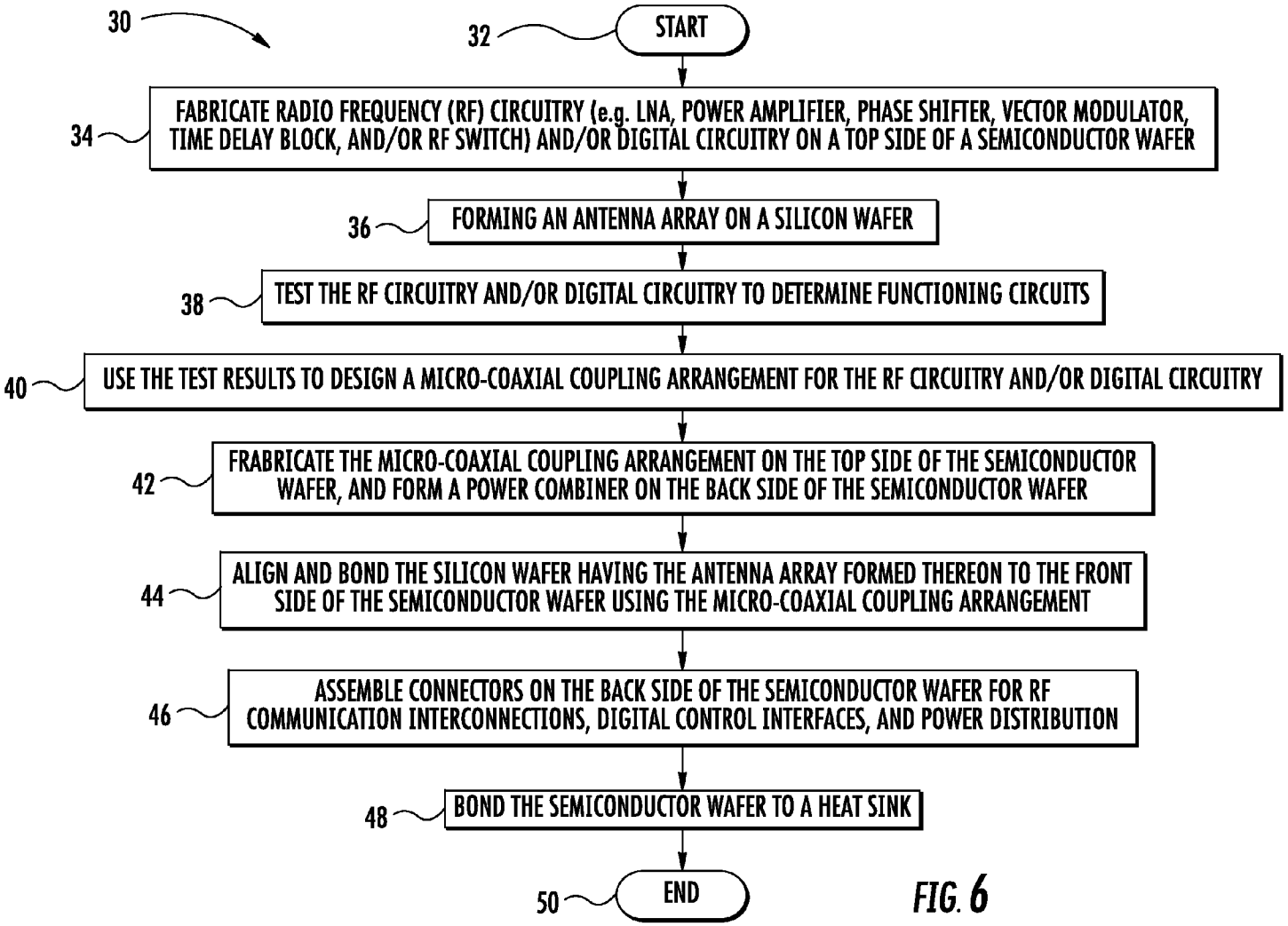
FIG. 6 is a flowchart of a method of making a phased array antenna module in accordance with the present invention.

With additional reference to the flowchart 30 of FIG. 6, a method of making a phased array antenna module 10 is now described. After the start (Block 32), an array of unconnected RF and/or digital circuitry 14 is fabricated by suitable SiGe BiCMOS, or CMOS, semiconductor foundry fabrication processes on a top side of the semiconductor wafer 12 (Block 34), as shown in FIG. 3. In addition, a logic bus 15 is designed in wafer streets between the RF circuitry 12, as also shown in FIG. 3. This logic bus allows for digital control of the various components of the RF circuitry 14.

Next, an array of antenna elements 36 is formed on a silicon wafer 26 (Block 36) by suitable manufacturing processes such as PolyStrata™, disclosed by Nuvotronics, LLC in Radford, Va. Then, the RF and/or digital circuitry 14 is tested to determine which circuits are functioning (Block 38).

Thereafter, the test results are used to design a micro-coaxial coupling arrangement 18 for the RF circuitry and/or the digital circuitry 14 (Block 40). Then, the micro-coaxial coupling arrangement 18 is fabricated on the top side of the semiconductor wafer 12, and a power combiner 22 is formed on the back side (Block 42).

Figure 5:
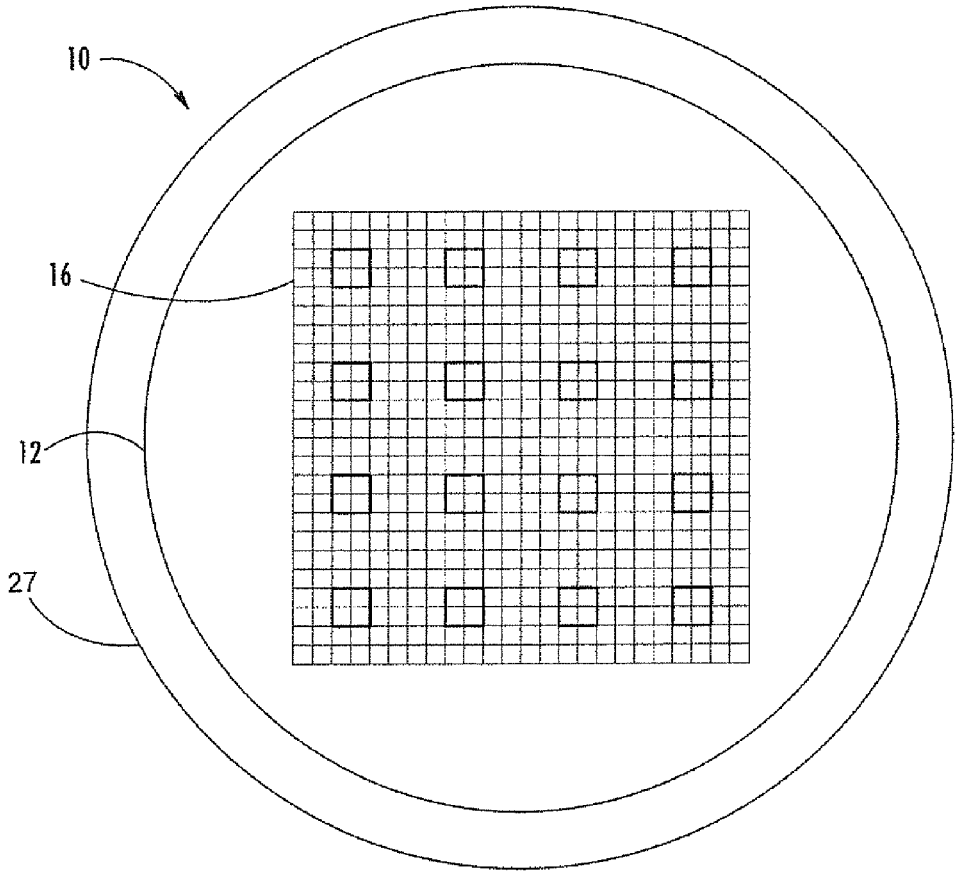
FIG. 5 is a top view of the phased array antenna being constructed, showing a heat sink being attached to the semiconductor wafer.

The silicon wafer 26 having the antenna array formed thereon is then aligned with and bonded to the front side of the semiconductor wafer 12 using the micro-coaxial coupling arrangement 18 (Block 44). Connectors 24 are then assembled on the back side of the semiconductor wafer 12 for RF communication interconnections, digital control interfaces, and power distribution (Block 46). The semiconductor wafer 12 is then bonded to a heat sink 27 (Block 48), as shown in FIG. 5. Block 50 indicates the end of the method.

The advantages of this method of production are numerous. In the prior art, integrated circuits (ICs) are fabricated individual dies on a wafer, and then separated from the wafer. The IC dies are then rearranged and manually assembled so as to produce a phased array antenna module. This is time consuming and increases the cost of production.

Designing unconnected arrays of RF components 14 on the semiconductor wafer 12 in their desired positions with no need for manual detachment, rearrangement, and attachment, greatly decreases the cost of producing the phased array antenna module 10. In addition, the fact that the array of antenna components 16 can be formed and attached in a variety of fashions allows for greater flexibility in construction of different phased array antenna modules 10. Moreover, the coaxial connections and redundant RF circuit elements 18, 24 allow for an increase in wafer yield, minimizing cost, because the RF circuitry 14 can be tested prior to coaxial connection formation, so that only good RF circuitry is connected to the array of antenna elements 16 using the coaxial connections.

In addition, since a whole wafer may be used to form the phased array antenna module 10, tens of thousands of circuit elements may be integrated into the wafer. Therefore, the phased array antenna module 10 may be suitable for handling high frequency signals in the 15 GHz to 100 GHz range. It should be understood that any RF circuitry 14 and any array of antenna elements 16 may be used.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A phased array antenna comprising:

a semiconductor wafer;

circuitry fabricated on a top side of said semiconductor wafer;

an array of phased array antenna elements above the top side of said semiconductor wafer; and a coaxial coupling arrangement coupling said circuitry to said array of phased array antenna elements.

2. The phased array antenna of claim 1, wherein said coaxial coupling arrangement comprises a plurality of coaxial connections, each comprising an outer conductor, an inner conductor, and a dielectric material therebetween.

3. The phased array antenna of claim 2, wherein said dielectric material comprises air.

4. The phased array antenna of claim 1, wherein said circuitry comprises RF circuitry.

5. The phased array antenna of claim 4, wherein said RF circuitry comprises at least one of a low noise amplifier, a power amplifier, a phase shifter, a vector modulator, a time delay block, and a RF switch.

6. The phased array antenna of claim 1, wherein said circuitry comprises digital circuitry.

7. The phased array antenna of claim 1, wherein said semiconductor wafer has a plurality of conductive vias therein coupled to said circuitry; and further comprising a power combiner on a back side of said semiconductor wafer coupled to at least some of said plurality of conductive vias.

8. The phased array antenna of claim 7, wherein said power combiner comprises a plurality of coaxial connections, each comprising an outer conductor, an inner conductor, and a dielectric therebetween.

9. The phased array antenna of claim 1, wherein said semiconductor wafer comprises a semiconductor wafer with circuitry fabricated in SiGe BiCMOS or CMOS semiconductor fabrication processes on the top side.

10. The phased array antenna of claim 1, further comprising a heat sink coupled to a back side of said semiconductor wafer.

11. A phased array antenna comprising:

a semiconductor wafer having a plurality of conductive vias therein;

circuitry fabricated on a top side of said semiconductor wafer and coupled to said plurality of conductive vias;

an array of antenna elements above the top side of said semiconductor wafer;

a plurality of coaxial connections between said circuitry and said array of antenna elements, each comprising an outer conductor, an inner conductor, and a dielectric material therebetween; and a power combiner on a back side of said semiconductor wafer coupled to at least some of said plurality of conductive vias.

12. The phased array antenna of claim 11, wherein said dielectric material comprises air.

13. The phased array antenna of claim 11, wherein said circuitry comprises RF circuitry.

14. The phased array antenna of claim 13, wherein said RF circuitry comprises at least one a low noise amplifier, a power amplifier, a phase shifter, a vector modulator, a time delay block, and an RF switch.

15. The phased array antenna of claim 11, wherein said semiconductor wafer comprises a semiconductor wafer with circuitry fabricated in SiGe BiCMOS or CMOS semiconductor fabrication processes on the top side.

16. A method of making a phased array antenna comprising:

fabricating circuitry on a top side of a semiconductor wafer;

forming a coaxial coupling arrangement with the circuitry; and positioning an array of phased array antenna elements above the top side of the semiconductor wafer and coupled to the circuitry via the coaxial coupling arrangement.

17. The method of claim 16, wherein the circuitry comprises RF circuitry.

18. The method of claim 17, further comprising forming a plurality of conductive vias in the semiconductor wafer and coupled to the RF circuitry; and further comprising integrating a power combiner on a back side of the semiconductor wafer coupled to at least some of the plurality of conductive vies.

19. The method of claim 18, wherein the power combiner comprises a plurality of coaxial connections, each comprising an outer conductor, an inner conductor, and a dielectric material therebetween.

20. The method of claim 19, wherein the dielectric comprises an air.

21. The method of claim 16, further comprising coupling a heat sink to a back side of the semiconductor wafer.

* * * * *